US005963181A

United States Patent [19]

Abe

[11] Patent Number: 5,963,181

[45] Date of Patent: Oct. 5, 1999

[54] ANTENNA, METHOD OF MANUFACTURING ANTENNA, AND ELECTRONIC APPARATUS EQUIPPED WITH ANTENNA

[75] Inventor: Hiroyuki Abe, Tokyo, Japan

[73] Assignee: Casio Computer Co., Ltd., Tokyo, Japan

[21] Appl. No.: 08/981,746

[22] PCT Filed: May 2, 1997

[86] PCT No.: PCT/JP97/01513

§ 371 Date: Dec. 31, 1997

§ 102(e) Date: Dec. 31, 1997

[87] PCT Pub. No.: WO97/43798

PCT Pub. Date: Nov. 20, 1997

[30] Foreign Application Priority Data

May 14, 1996 [JP] Japan ..... 8-119254

[51] Int. Cl.[6] ..... H01Q 1/36; G04B 47/00

[52] U.S. Cl. ..... 343/895; 368/10; 368/11; 343/718; 343/700 MS; 455/351

[58] Field of Search ..... 343/895, 718, 343/788; 336/83; 368/10

[56] References Cited

U.S. PATENT DOCUMENTS

| | | | |
|---|---|---|---|
| 3,055,003 | 9/1962 | Marston et al. | 343/756 |
| 4,843,404 | 6/1989 | Benge et al. | 343/895 |
| 5,790,477 | 6/1997 | Hauke | 368/10 |

FOREIGN PATENT DOCUMENTS

| | | |
|---|---|---|
| 0 382 130 | 8/1990 | European Pat. Off. . |
| 0 547 563 A1 | 6/1993 | European Pat. Off. . |
| 0 704 928 | 4/1996 | European Pat. Off. . |
| 0 766 152 | 4/1997 | European Pat. Off. . |
| 42 05 084 | 9/1993 | Germany . |
| 195 11 300 | 10/1996 | Germany . |
| 673 748 G A3 | 4/1990 | Switzerland . |

*Primary Examiner*—Don Wong
*Assistant Examiner*—James Clinger
*Attorney, Agent, or Firm*—Frishauf, Holtz, Goodman, Langer & Chick, P.C.

[57] ABSTRACT

An antenna for use in an electronic apparatus includes a plurality of insulating film substrates arranged side by side. The insulating film substrates each have a first surface and a second surface opposite to the first surface, and a connector piece is positioned between adjacent ones of the insulating film substrates for connecting the insulating film substrates in series. Each connector piece is bendable so as to stack the insulating film substrates one on another. A spiral wire is provided on at least the first surface of each of the insulating film substrates, and an electrical connection portion is formed in at least one of an outer circumferential section and an inner circumferential section of each of the spiral wires. A connection pattern is formed on the second surface of each of the insulating film substrates for electrically connecting adjacent ones of the spiral wires via the electrical connection portions.

4 Claims, 7 Drawing Sheets

ANTENNA, METHOD OF MANUFACTURING ANTENNA, AND ELECTRONIC APPARATUS EQUIPPED WITH ANTENNA

TECHNICAL FIELD

The present invention relates to an antenna, a method of manufacturing an antenna, and an electronic apparatus equipped with the antenna.

BACKGROUND ART

There is a demand regarding for an electronic apparatus equipped with a radio wave receiving function which would enable the apparatus to have functions of television, radio, character broadcasting, FM multiple broadcasting, mobile pager, GPS (global position system) and the like. Some of these functions have been realized in practice. In addition, these are apparatuses which have been practically realized to achieve other functions. For example, a radio wave wrist watch has been realized which adjusts the time by receiving time data transmitted via radio wave, so as to display the accurate time.

The above-described type of apparatus requires antenna for receiving transmitted radio waves. For example, a conventional wrist watch or the like has a structure in which a loop antenna is disposed in the wrist band having a flat surface, utilizing its shape, or a structure in which an antenna member wound in coil-like manner is disposed in the watch case.

However, with the structure in which the-antenna is disposed within the watch band, an adequate length of the antenna cannot be provided due to the limited length of the band, or a sufficient water-proof property cannot be maintained due to the structure in which the antenna is electrically connected to the internal portion of the watch case. With the structure in which the coil-like antenna member is disposed within the watch case, the shape of the antenna becomes large as the number of turns of the coil-like antenna increases, and therefore the size or thickness of the wrist watch increases, making it difficult to handle the watch. In addition to that, due to the enlargement of the antenna, the area for displaying data such as time, must be decreased in size, making it difficult for the user to read the data. This is the case not only for the wrist watch but also for other electronic apparatuses.

An object of the present invention is to provide an antenna having a sufficient length but a small size, thereby making it possible to reduce the electronic apparatus in thickness and size.

Another object of the present invention is to provide an electronic apparatus having a structure in which the antenna is built in the case of the apparatus, thus making it possible to reduce the apparatus in thickness and size.

DISCLOSURE OF INVENTION

The antenna of the present invention is characterized in that a plurality of insulating film substrates, each having at least a first surface on which a spiral wire is provided, are stacked one on another, and the wires provided on the insulating film substrates are electrically connected to each other.

This antenna has a structure in which a plurality of insulating film substrates are stacked one on another, and therefore it is made thin as a whole. The wires wound in a spiral manner are provided on the respective insulating film substrates stacked one on another. With this structure, the total number of turns of the spiral wires can be increased, and therefore a sufficient length of wire as an antenna can be obtained.

In this antenna, each insulating film substrate has a structure in which a connection portion to be electrically connected to the wire of another insulating film which is stacked thereon, is situated at an end of the periphery of the film substrate. Thus, the wires of the insulating film substrates are electrically connected to each other via the connection portions.

With this structure, the wires of the insulation films stacked one on another are electrically connected to each other, and therefore a sufficient length of the wires as a whole antenna can be obtained.

An electronic apparatus having the antenna of the present invention is characterized by including a flat plate antenna made of a plurality of flat plate-like insulating film substrates, each having at least a first surface on which a spiral wire is provided, stacked one on another, such that the wires provided on the insulating film substrates are electrically connected to each other. In addition, a signal processing unit for processing signals received by this antenna.

With the above-described structure in which a plurality of insulating film substrates each having spiral wire formed thereon are stacked one on another as an antenna, a sufficient length of antenna can be obtained despite of its thin structure and small size. The processing circuit serves to process signals received by this antenna, and functions as an electronic device. Thus, the entire structure of the electronic apparatus can be reduced in size.

A wristwatch having the antenna of the present invention is characterized by including a flat plate antenna made of a plurality of flat plate-like insulating film substrates, each having an opening at a center portion thereof, and at least a first surface on which a spiral wire is provided, stacked one on another, such that the wires provided on the insulating film substrates are electrically connected to each other. The wristwatch also includes, a watch face disposed to be stacked on the flat plate antenna, an analog movement having a shaft of an indicator hand, which is pierced through the opening of the antenna, and an indicator hand provided on the shaft of the analog movement, and rotating above the watch face.

The face disposed to be stacked on the antenna, the analog movement having the hand shaft which is pierced through the opening of the antenna, and the hand provided on the hand shaft will make up the main portion of a wrist watch for indicating the time. Thus, a wrist watch as an electronic apparatus is manufactured. The antenna of the wrist watch has a structure in which a plurality of insulating films each provided with a spiral wire formed thereon, are stacked one on another. Therefore, the antenna can be made thin and small in size. Further, the display area of the time is not limited due to the size of the antenna, and a sufficient display area can be obtained. Consequently, the apparatus can be thinned and reduced in size.

BEST MODE OF CARRYING OUT THE INVENTION

Figure 1:
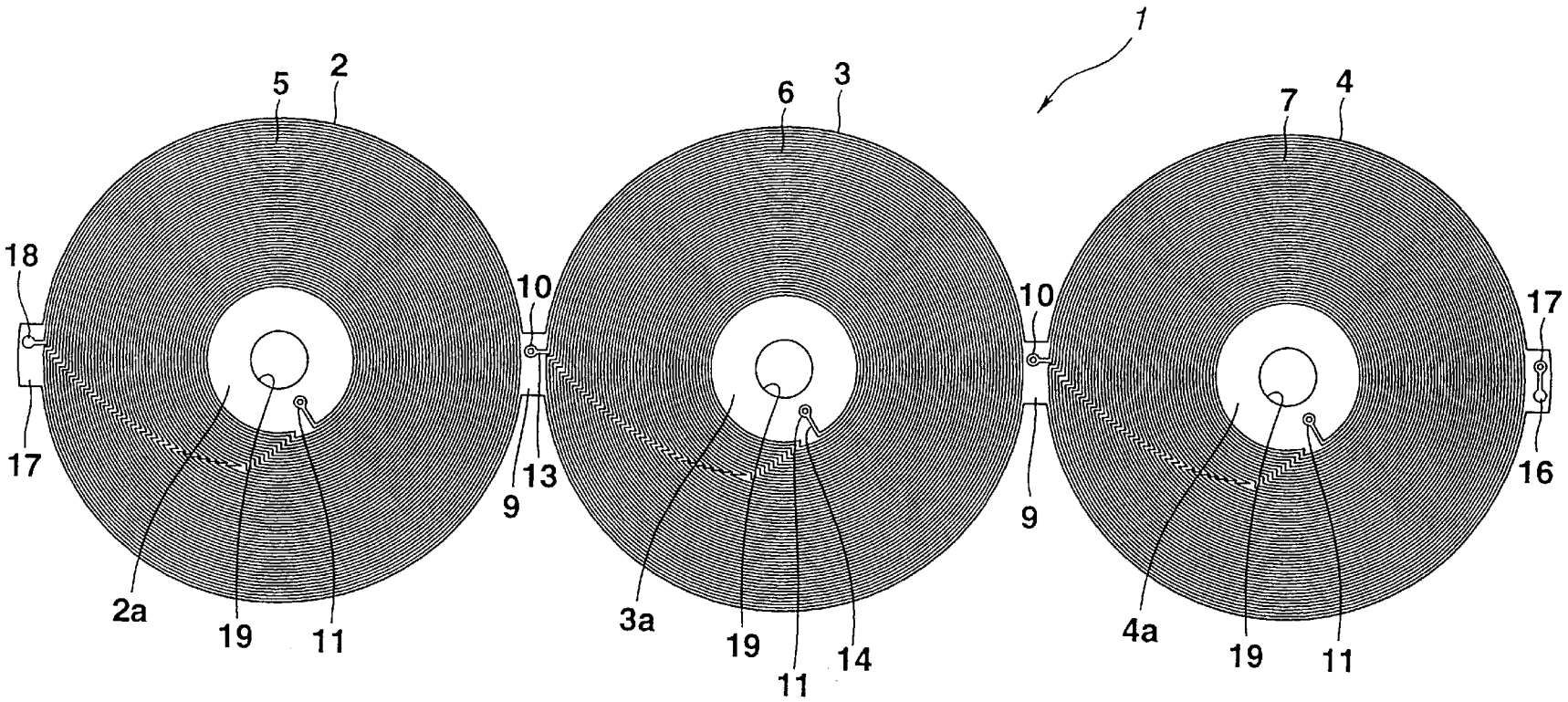
FIG. 1 is a plan view showing the antenna of the present invention when it is developed.
Figure 2:
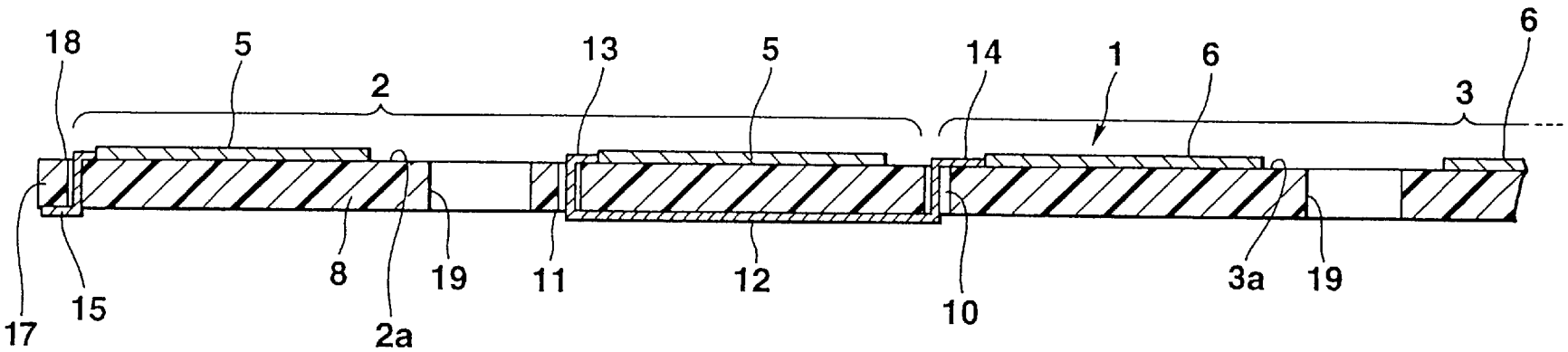
FIG. 2 is an enlarged cross section of the main portion of the antenna when developed shown in FIG. 1.

FIGS. 1 to 4 show the antenna of the present invention. FIG. 1 shows the antenna of the present invention when it is developed, and FIG. 2 is a cross section of the main portion of the antenna when it is developed. As shown in FIG. 1, insulating film substrates 2, 3 and 4 each having a circular shape in its plan view, are connected in series side by side to each other in a horizontal direction. Spiral wires 4, 5 and 6 are provided on respective sides of the respective insulating film substrates 2, 3 and 4. The wires 5, 6 and 7 can be formed in a similar manner to that of print wiring substrates, more specifically, a conductive material is printed on a insulating film 8 (see FIG. 2) in a spiral fashion, and then a insulating resin is laminated on the print surface. Subsequently, the resultant is cut such circular pieces are joined side by side to each other, and thus the circular insulating film substrates 2, 3 and 4 joined in series to each other as shown in FIG. 1 when developed, can be obtained.

Figure 4:
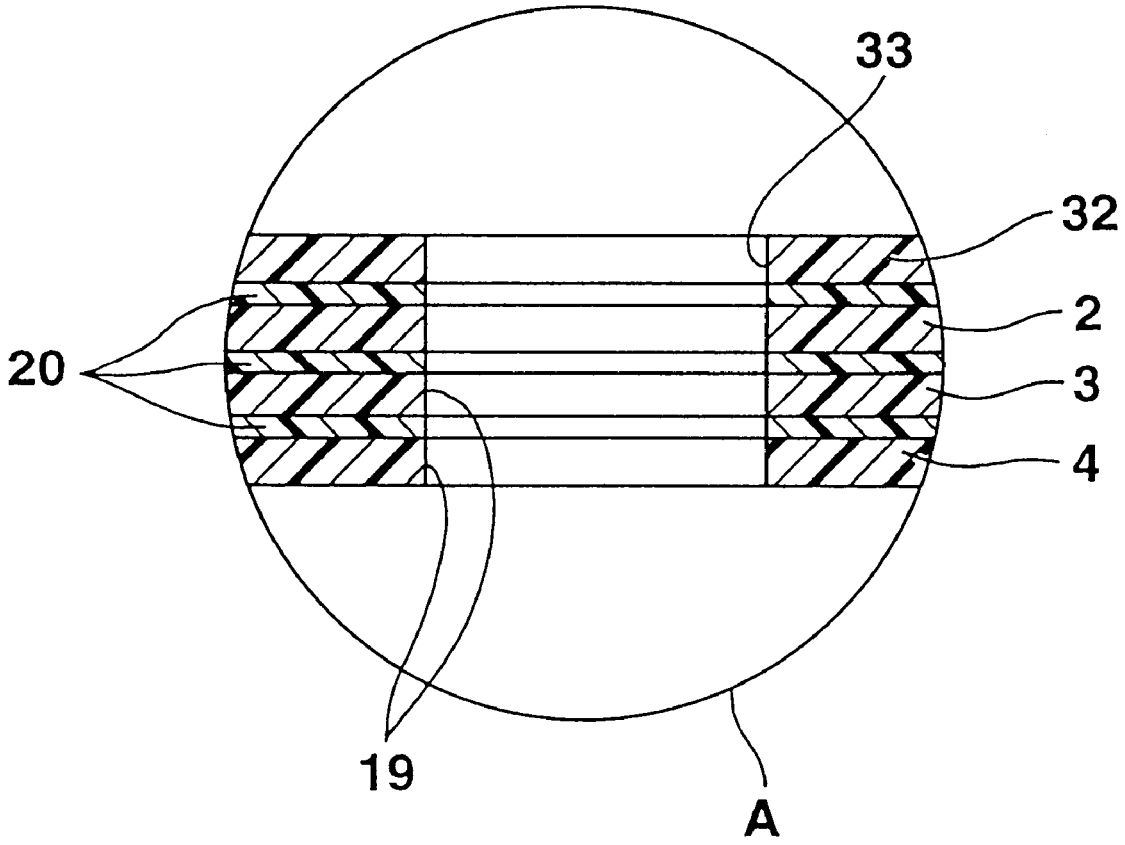
FIG. 4 is an enlarged cross sectional view of a portion A shown in FIG. 3.

In FIG. 4, a joint piece 9 is a connecting portion formed at each of a periphery portion between the substrates 2 and 3 and a periphery portion between the substrates 3 and 4, so as to connect the insulating film substrates 2, 3 and 4 with each other. Each connecting portion has a through-hole 10 which pierces through vertically, at an appropriate location. The inner circumferences of the insulating film substrates 2, 3 and 4 are blank portions 2*a*, 3*a* and 4*a*, respectively, where the respective wires 5, 6 and 7 are not provided. Each inner circumference has a through-hole 11 which pierces therethrough vertically. The wires 5, 6 and 7 of the insulating film substrates are joined in series to each other and electrically connected to each other via the through-holes 10 and 11.

FIG. 2 shows a structure in which the wires 5 and 6 formed on the first insulating film substrate 2 and the second insulating film substrate 3 are electrically connected to each other. The second insulating film substrate 3 and the third insulating film substrate 4 are connected to each other by means of the same structure as that just mentioned. The connection is carried out via the through-hole 11 located in the inner circumferential section of the insulating film substrate 2 and the through-hole 11 located between the first and second insulating film substrates 2 and 3. Therefore, as shown in FIG. 2, a connection pattern 12 is formed on the rear surface of the insulating film substrate 8 between the through-holes 10 and 11. On the surface of the insulating film 8, a connection pattern 13 is formed from the wire 5 of the first insulating film substrate 2 towards the through-hole 11, and a connection pattern 14 is formed from the wire 6 of the second insulating film substrate 3 towards the through-hole 10. The connection patterns 13 and 14 are connected to the connection pattern 12 on the rear surface of the insulating film 8 via conductive materials in the through-holes 11 and 10, respectively, and thus the wires 5 and 6 are electrically connected to each other.

Further, on the insulating film substrates 2 and 4 located on extreme sides and electrically connected to each other, connection electrodes 15 and 16 are formed respectively, to be electrically connected to the connection terminals (not shown) in the electronic apparatus. These connection electrodes 15 and 16 are formed on connection pieces 17 extended respectively to the outer circumferential sides of the first and third insulating film substrates 2 and 4 in the direction in which substrates are connected in series.

In the embodiment shown in the figure, an odd number of, specifically, three, insulating film substrates 2, 3 and 4 are provided, and therefore one of the connection electrodes, namely, the connection electrode 12, is provided on the reverse surface of the insulating film 8, whereas the other ones, the connection electrodes 13 and 14 are provided on the surface of the insulating film 8. In this embodiment, the connection electrode 15 located on the side of the first insulating film substrate 2 is situated on the reverse side, whereas the connection electrode 16 located on the side of the third insulating film substrate 4 is situated on the obverse side. With regard to the connection electrode 15 situated on the reverse side, a through-hole 18 is made in the connection piece 17 on the side of the first insulating film substrate 2. The connection electrode 15 and the wire 5 on the first insulating film substrate 2 are electrically connected to each other via the through-hole 18 due to a similar structure to that described above, as shown in FIG. 2. Apart from this embodiment, in the case where there are an even number of insulating film substrates 2, 3 and 4, both connection electrodes may be provided on the same side (for example, adverse side) as those of the insulating film 8 or on both sides respectively.

Figure 3:
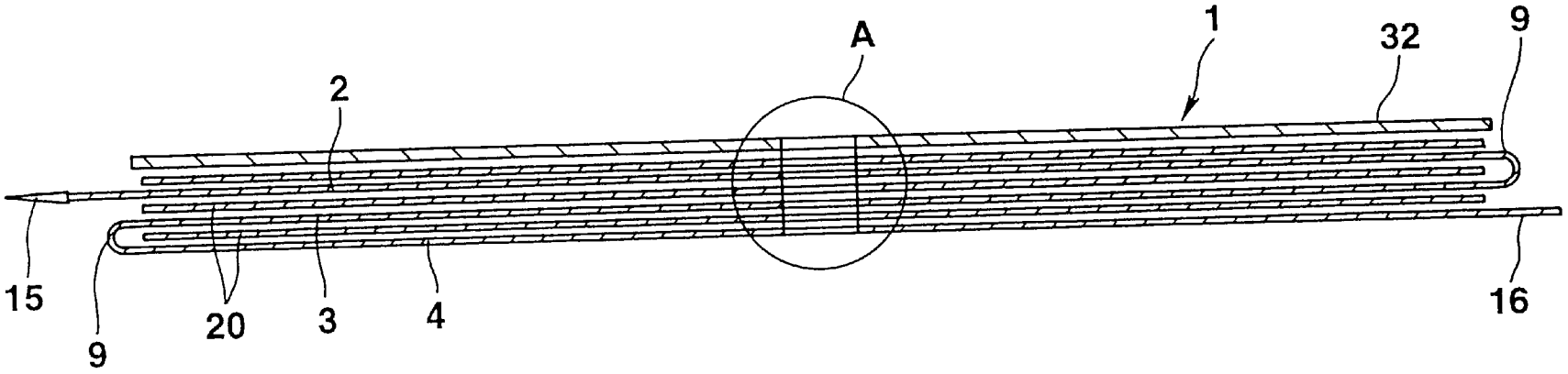
FIG. 3 is a cross sectional view of an antenna formed by stacking a plurality of insulating film substrates.

The antenna 1 of this embodiment is formed by stacking a plurality of insulating film substrates 2, 3 and 4 which are developed as described above, one on another. FIGS. 3 and 4 show an example in which the substrates are stacked one on another. As can be seen in these figures, each of the connection pieces 9 which serve as borders between substrates, is bent over, and the insulating film substrates 2, 3 and 4 are thus stacked one on another. Between every two of the insulating film substrates 2, 3 and 4, stacked one on another, a both-side adhesive sheet 20 is inserted, and thus the insulating film substrates 2, 3 and 4 are adhered to each other by means of the both-side adhesive sheets 20. Therefore, the displacement of the substrates can be prevented.

Due to its structure in which a plurality of insulating film substrates 2, 3 and 4 are stacked one on another, the antenna is formed thin as a whole. On the insulating film substrates 2, 3 and 4 stacked one on another, the wires 5, 6 and 7 connected to each other are formed respectively in a spiral manner. A sufficient length of the antenna can be obtained.

Figure 5:
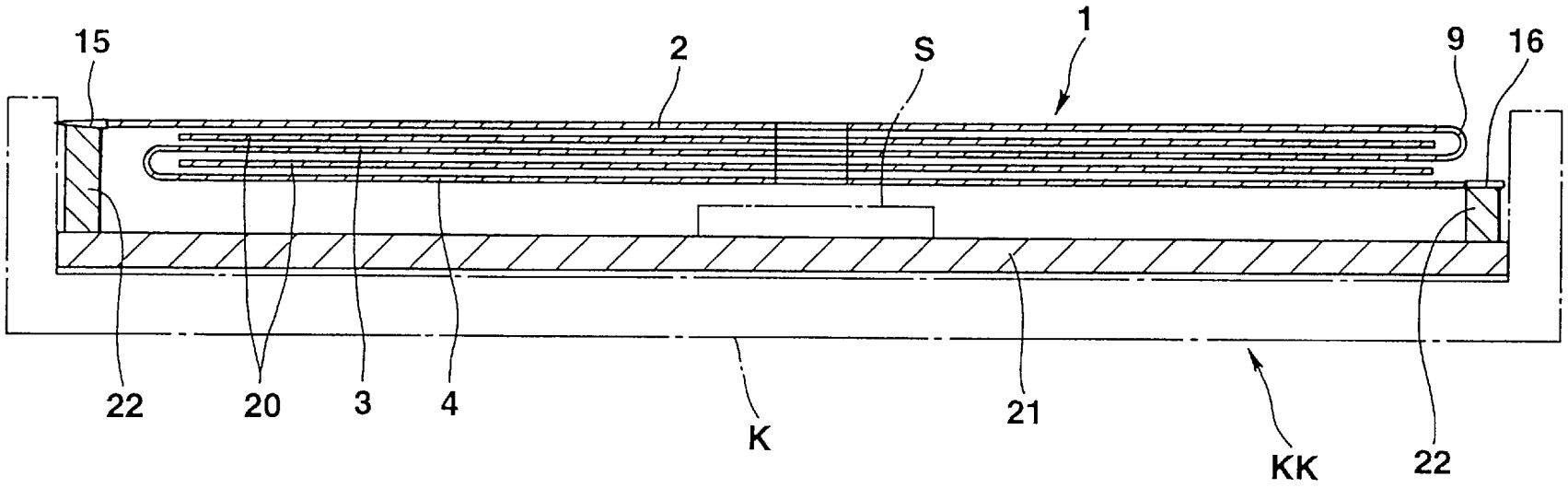
FIG. 5 is a cross sectional view of the main portion of the antenna shown in FIG. 3 which it is built in the apparatus case.

FIG. 5 shows an internal structure of an electronic apparatus KK in which the antenna 1 is used. The antenna 1 has a flat plate-like structure in which a plurality of insulating film substrates 2, 3 and 4 are stacked one on another, and it is built in an apparatus case K. In the apparatus case K, a circuit substrate 21 having a processing circuit S (signal receiving circuit) is provided, and the connection electrode 15 of the first insulating film substrate 2 and the connection electrode 16 of the third insulating film substrate 4 are connected to the circuit substrate 21 via a connection terminal.

The processing circuit S of the circuit substrate 21 serves to process signals received by the antenna 1. With the above-described structure, signals received by the antenna 1 is input via each connection terminal 22 to the processing circuit S of the circuit substrate 21, where the received signals are processed therein. The electronic apparatus KK described above can be formed to have a structure with a sufficient length of the antenna 1. Consequently, the whole structure of the electronic apparatus KK can be made thin and small.

An embodiment in which the present invention is applied to a wrist watch as an electronic apparatus will now be described with reference to FIGS. 1, 3, 4, 6 and 7. As can be seen in FIG. 1 which illustrates the antenna 1 when it is developed, an opening 19 is made at a central section of each of the insulating film substrates 2, 3 and 4. As shown in FIG. 7 which will be later explained, the opening 19 is made such that a hand shaft 31 of an analog movement 30 can pierce therethrough. Further, the antenna 1 is made by stacking insulating film substrates 2, 3 and 4 one on another as shown in FIG. 3. The substrates are stacked in such a manner that the openings 19 thereof are aligned to be pierced through as shown in FIG. 4.

FIG. 3 shows the insulating film substrates 2, 3 and 4 stacked so as to make the antenna 1, and as shown in this figure, the connection electrodes 15 and 16 of the first and third insulating film substrates 2 and 4 extend out from the periphery of the stacked section.

On the antenna 1, a face 32 of the watch is placed via an insulating double-sided adhesive sheet 20. The face 32 has a surface on which time indicators are printed or lithographed or the like as shown in FIG. 6, and is formed in substantially the same shape as that of the antenna 1.

As shown in FIG. 4, the face 32 has an opening 33 through which the hand shaft 31 of the analog movement is pierced, such that the opening 33 is connected to the opening 19 of the antenna 1.

Figure 6:
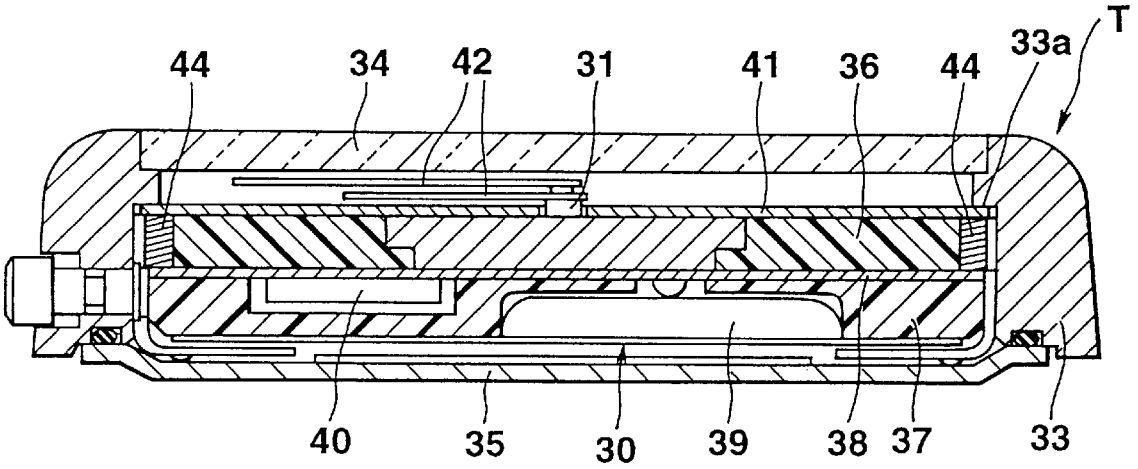
FIG. 6 is a cross sectional view of a wrist watch in which the antenna shown in FIG. 3, is built.
Figure 7:
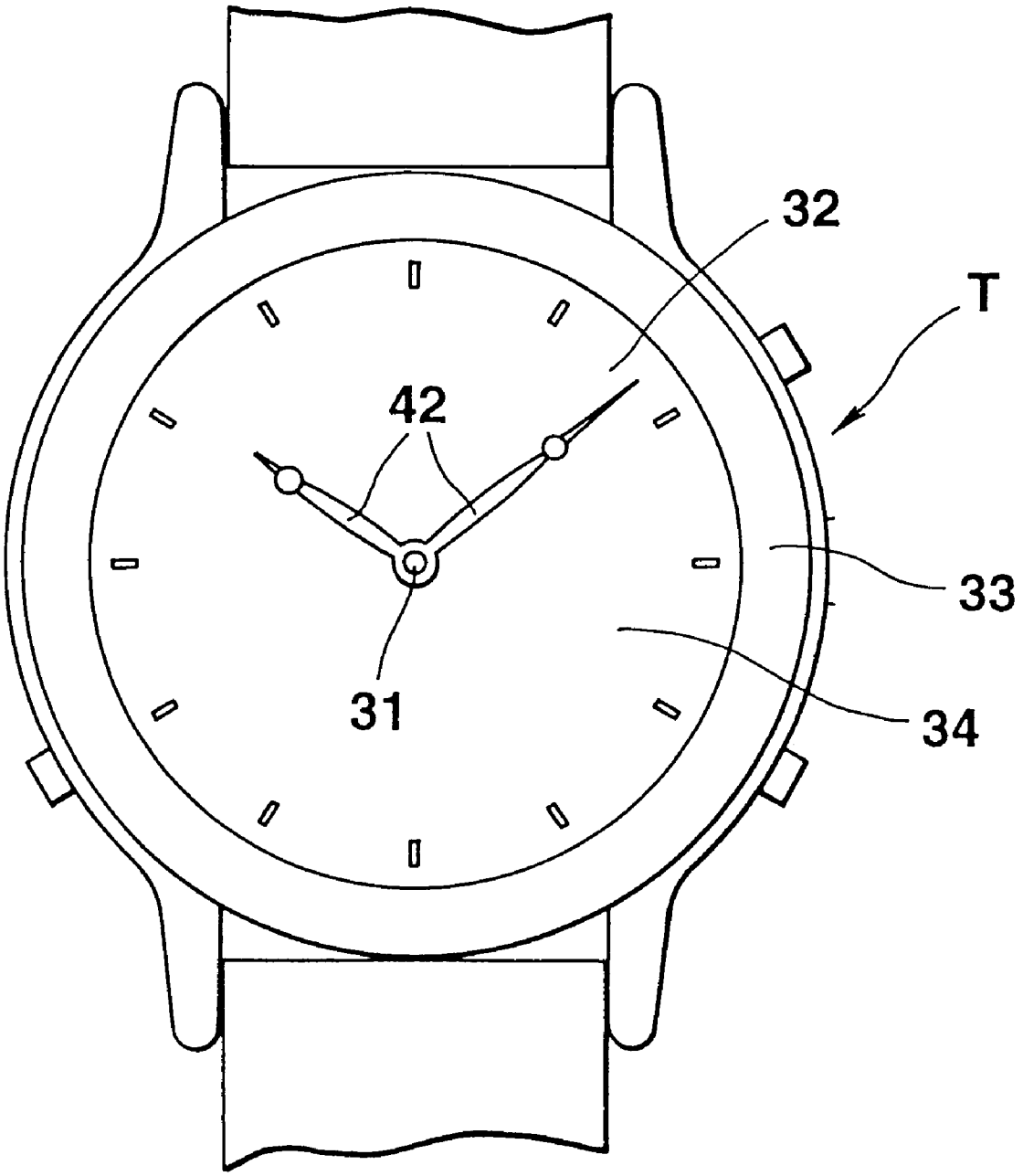
FIG. 7 is a front view of the wrist watch shown in FIG. 6.

FIG. 6 shows the internal structure of a wrist watch T according to this embodiment. The wrist watch T includes a watch case 33 and an analog movement 30 built in the watch case 33. On the top of the watch case 33, a cover glass 34 is engaged, and a rear cover 35 is mounted to the bottom of the case, thus the internal structure is sealed.

The analog movement 30 is built in the watch case 33 from the rear cover 35. Regarding the analog movement 30, the circuit substrate 38 is held by the upper and lower housings 36 and 37 to be sandwiched therebetween, and a button-shaped battery 39 for supplying electrical power to the circuit substrate 38 is held in the lower housing 37. Further, an LSI 40 is mounted on the rear surface side of the circuit substrate 38. The LSI 40 includes a clock circuit (not shown), and a processing circuit (signal receiving circuit) for processing signals received by the antenna 1. Further, the analog movement 30 has the hand shaft 31 which extends upwards.

A lamination assembly 41 placed on the upper surface of the analog movement 30 is made by laminating the antenna 1 and the watch face 32 shown in FIG. 3, and the lamination assembly is built in the watch case 33 as the periphery portion of the upper surface thereof is engaged to a stepped portion 33*a* in the watch case 33, and the lower surface is supported by the analog movement 30.

The lamination assembly 41 has connection electrodes 15 and 16 which extend from the periphery as shown in FIG. 3, and an upper section of an inter-connector 44 made of an electro-conductive coil spring is brought into contact with the connection electrodes 15 and 16. An lower portion of the inter-connector 44 is brought into contact with a connection terminal portion (not shown) formed on the upper surface of the circuit substrate 38. Therefore, signals received by the antenna 1 are input via the inter-connector 44 to the LSI 40 of the circuit substrate 38, where the signals processed by the signal receiving circuit of the LSI 40. With this structure, the wrist watch becomes capable of not only indicating the time, but also other functions such as radio, mobile pager and GPS, and thus the utility of the watch can be significantly improved.

As shown in FIG. 4, the lamination assembly 41 has the openings 19 and 33 which are connected to each other, and the hand shaft 31 of the analog movement 30 is pierced through the connected openings 19 and 33. As shown in FIG. 7, the indicators 42 such as hour hand and minute hand are set on the hand shaft 31, and as the indicators rotates above the face 32 of the lamination assembly 41, the time is indicated. In the indication of time used by this embodiment, it is possible that the time data transmitted via radio wave is received by the antenna 1, and the received time data is output to the signal receiving circuit of the LSI 40.

With the above-described operation, the adjustment of time for the indicators 42 can be carried out automatically on the basis of the time data. Therefore, the adjustment of time, which is sometimes cumbersome, becomes unnecessary, and the accurate time can be indicated at all times, which are very advantageous.

The wrist watch of this embodiment is capable of installing the above-described useful functions, and it has the antenna 1, which is so thin and small that the indicating area of the face 32 is not limited. Therefore, not only it is possible to maintain a large indicating area for the face 32, but also the wrist watch itself can be made thin and small.

The present invention is not limited to the above discussed embodiments, but can be remodeled into various versions. For example, the present invention can be applied to a radio, television, character information broadcasting, FM multiplex receiver, mobile telephone, pager, PGS system, electronic note book, transceiver, or other electronic devices. Apart from the embodiments discussed, a wire may be formed on both sides of an insulating film substrate.

The antenna of the present invention has a structure in which a plurality of insulating film substrates on each of which a spiral wire is provided, are stacked one on another. With this structure, a fully sufficient length of antenna can be obtained while the size of the whole antenna can be reduced.

The electronic apparatus according to the present invention is provided with such an antenna inside, and therefore it can be made small and thin while being capable of accurately receiving signals.

I claim:

1. An antenna comprising:

a plurality of insulating film substrates arranged side by side, said insulating film substrates each having a first surface and a second surface opposite to said first surface;

a connector piece positioned between adjacent ones of said insulating film substrates for connecting said insulating film substrates in series, each said connector piece being bendable so as to stack said insulating film substrates one on another;

a spiral wire provided on at least the first surface of each of the insulating film substrates;

an electrical connection portion formed in at least one of an outer circumferential section and an inner circumferential section of each said spiral wire; and a connection pattern formed on said second surface of each of said insulating film substrates for electrically connecting adjacent ones of said spiral wires via said electrical connection portions.

2. A method of manufacturing an antenna, comprising:

arranging a plurality of insulating film substrates side by side in series with a connector piece positioned between adjacent ones of said insulating film substrates, said insulating film substrates each having a spiral wire provided on a first surface thereof, an electrical connection portion formed in at least one of an outer circumferential section and an inner circumferential section of each said spiral wire, and a connection pattern formed on a second surface opposite to said first surface for electrically connecting adjacent ones of said spiral wires via said electrical connection portions; and bending each said connector piece so as to stack said insulating film substrates one on another.

3. An electronic apparatus equipped with antenna, comprising:

an antenna including a plurality of insulating film substrates stacked one on another and arranged in series with a bendable connector piece positioned between adjacent ones of said insulating film substrates, said insulating film substrates each having a spiral wire provided on a first surface thereof, an electrical connection portion formed in at least one of an outer circumferential section and an inner circumferential section of each said spiral wire, and a connection pattern formed on a second surface opposite to said first surface for electrically connecting adjacent ones of said spiral wires via said electrical connection portions; and a signal processing unit for processing signals received by the antenna.

4. An electronic watch equipped with antenna, comprising:

a flat plate antenna including a plurality of insulating film substrates stacked one on another and arranged in series with a bendable connector piece positioned between adjacent ones of said insulating film substrates, said insulating film substrates each having an opening formed at a center portion thereof, a spiral wire provided on a first surface thereof, an electrical connection portion formed in at least one of an outer circumferential section and an inner circumferential section of each said spiral wire, and a connection pattern formed on a second surface opposite to said first surface for electrically connecting adjacent ones of said spiral wires via said electrical connection portions;

a watch face disposed on the flat plate antenna so that the openings formed in the insulating film substrates coincide with a center portion of the watch face;

an analog movement having a hand shaft which is pierced through the openings of the insulating film substrates and the center portion of the watch face; and an indicator hand mounted on the hand shaft of the analog movement and rotating above the watch face.

* * * * *